US006869249B2

(12) United States Patent
Calhoon

(10) Patent No.: US 6,869,249 B2
(45) Date of Patent: Mar. 22, 2005

(54) ADJUSTING DEVICE FOR INSTALLING A MANHOLE RING ONTO A MANHOLE

(76) Inventor: Stephen Calhoon, P.O. Box 336009, Greeley, Boulder, CO (US) 80633

( * ) Notice: Subject to any disclaimer, the term of this patent is extended or adjusted under 35 U.S.C. 154(b) by 0 days.

(21) Appl. No.: 10/691,988

(22) Filed: Oct. 23, 2003

(65) Prior Publication Data

US 2004/0091318 A1 May 13, 2004

Related U.S. Application Data

(60) Provisional application No. 60/422,324, filed on Oct. 30, 2002.

(51) Int. Cl.[7] ..... E02D 29/14
(52) U.S. Cl. ..... 404/26; 52/20
(58) Field of Search ..... 52/19.2; 404/25, 404/26

(56) References Cited

U.S. PATENT DOCUMENTS 948,539 A * 2/1910 Clark ..... 249/11
3,847,339 A 11/1974 Farrell
3,974,599 A * 8/1976 Grosh ..... 52/20
5,058,854 A 10/1991 Bravo
5,095,667 A * 3/1992 Ryan et al. ..... 52/20
5,328,294 A 7/1994 Miller
5,419,856 A * 5/1995 Shaw ..... 264/28
5,476,300 A 12/1995 Dodge
5,492,656 A * 2/1996 Tracy ..... 264/32
5,660,422 A 8/1997 Knisley
5,934,820 A * 8/1999 Hinkle ..... 404/26
6,149,803 A * 11/2000 DiLoreto et al. ..... 210/164
6,161,985 A 12/2000 Hinkle et al.

FOREIGN PATENT DOCUMENTS

WO WO 02/064894 8/2002

* cited by examiner

*Primary Examiner*—Thomas B. Will
*Assistant Examiner*—Alexandra Pechhold
(74) *Attorney, Agent, or Firm*—Emery L. Tracy

(57) ABSTRACT

An adjusting device for installing a manhole ring onto a manhole is provided. The manhole has an annular inner shoulder. The adjusting device comprises a center plate and at least one supporting arm. Each supporting arm has a first end and a second end with the first end of the supporting arm being securable to the center plate. A securement assembly associated with the center plate releasably holds the manhole ring.

8 Claims, 3 Drawing Sheets

ADJUSTING DEVICE FOR INSTALLING A MANHOLE RING ONTO A MANHOLE

The present application is a continuation of now abandoned provisional patent application Ser. No. 60/422,324, filed on Oct. 30, 2002, entitled "Adjusting Device for Installing a Manhole Ring onto a Manhole".

BACKGROUND OF THE INVENTION

1. Field of the Invention

This invention relates generally to an adjusting device for installing a manhole ring onto a manhole and, more particularly, the invention relates to an adjusting device for installing a manhole ring by setting the manhole ring at the desired grade below or above the road surface allowing the manhole ring and the manhole to be connected on site with one solid pour of concrete rather than using precast concrete shimming rings, steel shims, and grout.

2. Description of the Prior Art

Conventionally, after a manhole has been positioned below grade in a desired location, the manhole ring is positioned upon the manhole to allow access to the manhole after construction is complete. Prior to positioning the manhole ring onto the manhole, at least one concrete ring is positioned between the manhole ring and the manhole to raise the manhole ring to the proper grade. Steel shims are positioned between the last concrete ring and the manhole ring to level or tilt the manhole ring at the proper angle. Grout is then applied between all concrete rings and the manhole ring to seal the assembly from dirt and other debris and maintain the integrity of the interior of the assembly.

Unfortunately, the above-described procedure is very labor and material intensive and time consuming. Many man-hours are required to properly install the manhole ring onto the manhole. Furthermore, it is very difficult to properly set the manhole ring at the proper grade level given the fact that the concrete rings have a predetermined height and any adjustment must be accomplished with steel shims.

Accordingly, there exists a need for an adjusting device for installing a manhole ring onto a manhole which quickly and conveniently sets a manhole ring onto a manhole. Additionally, a need exists for an adjusting device for installing a manhole ring onto a manhole which eliminates the need for concrete rings, steel shims, and grout. Furthermore, there exists a need for an adjusting device for installing a manhole ring onto a manhole which connects the manhole ring to the manhole at the proper grade and angle with "one pour" of concrete.

SUMMARY

The present invention is an adjusting device for installing a manhole ring onto a manhole. The manhole ring has an annular inner shoulder. The adjusting device comprises a center plate and at least one supporting arm. Each supporting arm has a first end and a second end with the first ends of the supporting arm being securable to the center plate. A securement assembly associated with the center plate releasably holds the manhole ring.

In addition, the present invention includes a method for installing a manhole ring onto a manhole. The manhole ring has an annular inner shoulder. The method comprises providing at least one extension member, providing a clamping member, positioning the extension member on the annular inner shoulder of the manhole ring, positioning the clamping member under the annular inner shoulder of the manhole ring, clamping the annular inner shoulder of the manhole ring between the extension member and the clamping member, positioning the manhole ring upon the manhole, and unclamping the manhole ring.

The present invention further includes an assembly for installing a manhole ring onto a manhole. The manhole ring has an annular inner shoulder. The assembly comprises adjusting means for adjusting the position of the manhole ring, support means secured to the adjusting means for supporting the manhole ring, and securement means secured to the adjusting means for securing the manhole ring.

DETAILED DESCRIPTION OF THE PREFERRED EMBODIMENTS

Figure 1:
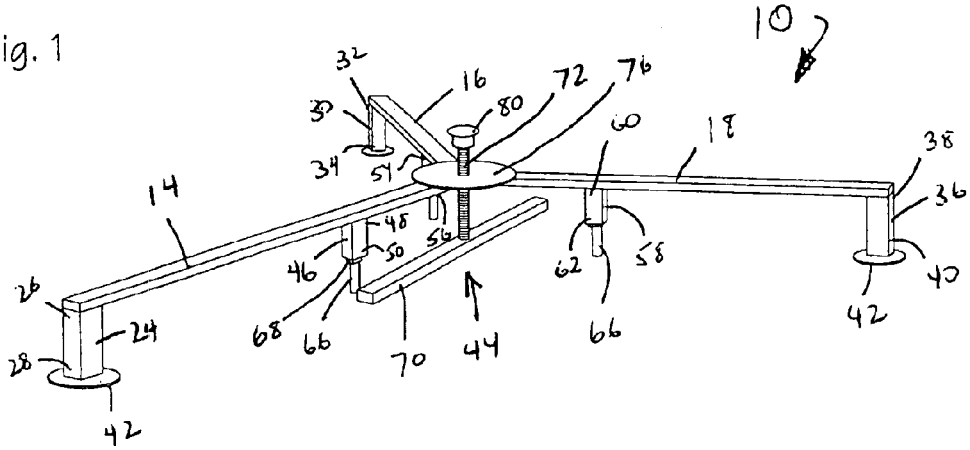
FIG. 1 is a perspective view illustrating the adjusting device for installing a manhole ring onto a manhole, constructed in accordance with the present invention.

As illustrated in FIG. 1, the present invention is an adjusting device, indicated generally at 10, for installing a manhole ring 12 (see FIG. 3) onto a manhole (not shown). The adjusting device 10 of the present invention allows the manhole ring 12 to be set upon a manhole at the desired angle and grade with minimal effort and manpower requirements.

Figure 2:
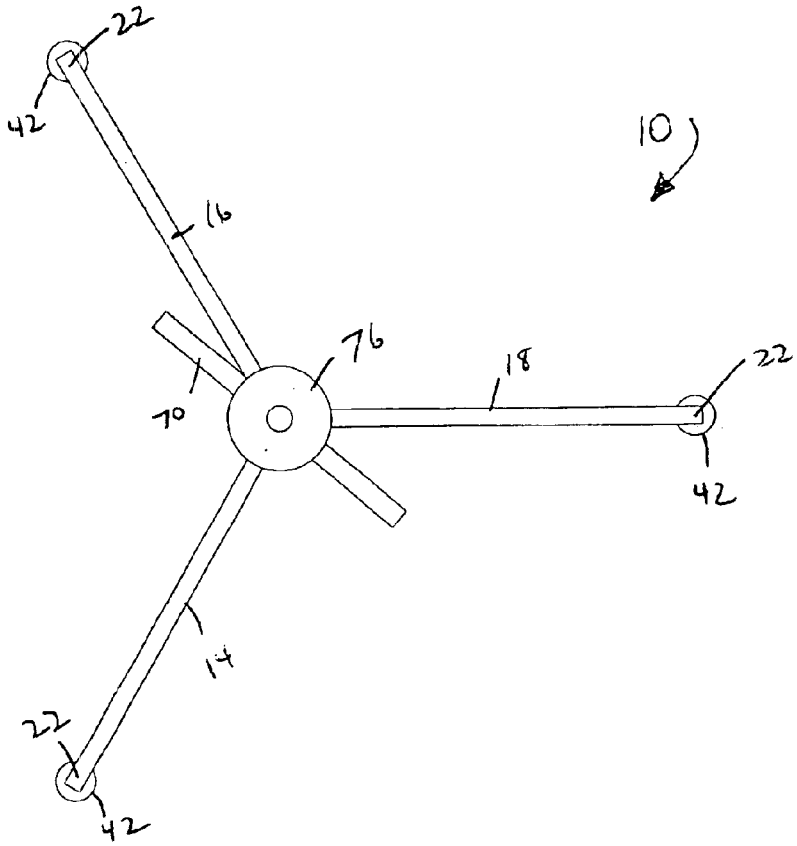
FIG. 2 is a top view illustrating the adjusting device of FIG. 1, constructed in accordance with the present invention.
Figure 4:
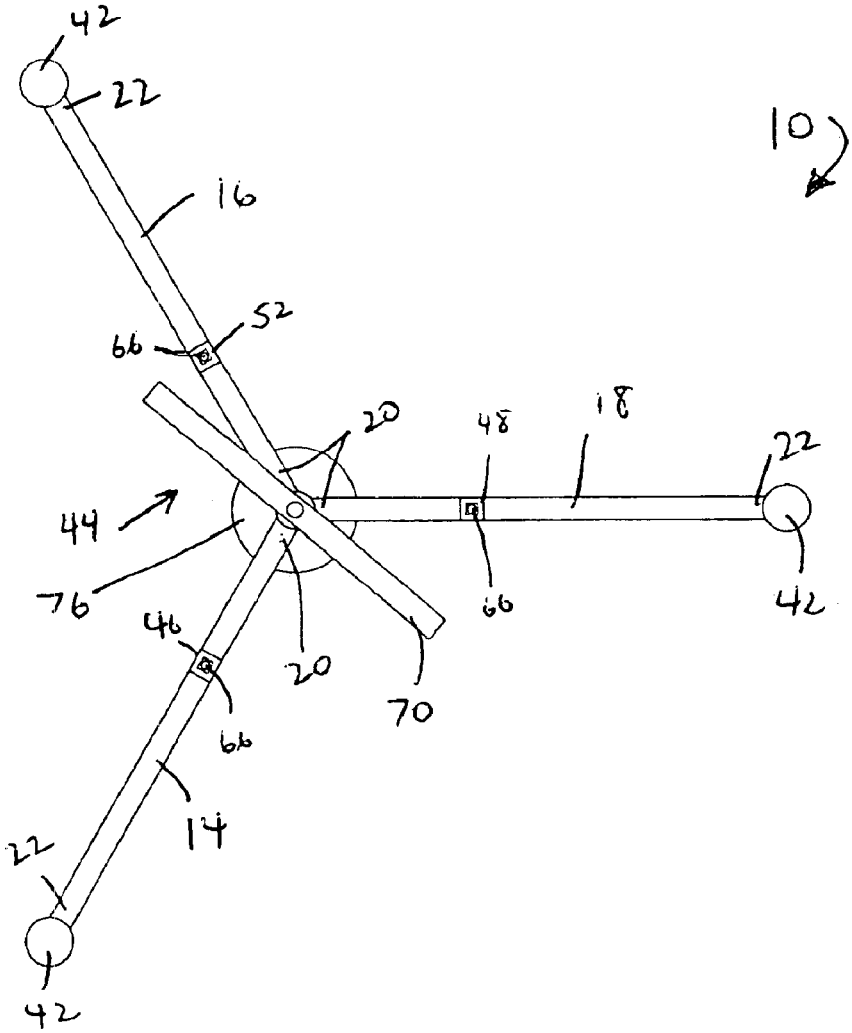
FIG. 4 is a bottom view illustrating the adjusting device of FIG. 1, constructed in accordance with the present invention.

As illustrated in FIGS. 2 and 4, the adjusting device 10 of the present invention includes a first supporting arm 14, a second supporting arm 16, and a third supporting arm 18 with each supporting arm 14, 16, 18 having a first end 20 and a second end 22. The first end 20 of each of the supporting arms 14, 16, 18 are welded or otherwise secured together such that the first supporting arm 14 is angled relative to the second supporting arm 16 at approximately one hundred and twenty (120°) degrees, the second supporting arm 16 is angled relative to the third supporting arm 18 at approximately one hundred and twenty (120°) degrees, and the third supporting arm 18 is angled relative to the first supporting arm 14 at approximately one hundred and twenty (120°) degrees. It should be noted that the angles between the supporting arms 14, 16, 18 are only the preferred construction of the adjusting device 10 and other angles between the supporting arms 14, 16, 18 are within the scope of the present invention.

It should be noted that it is within the scope of the present invention to have more than three supporting arms or less than three supporting arms depending on the desires of the manufacturer and/or the user. Furthermore, if desired, each of the supporting arms can be adjustable to adjust the height of the adjusting device 10.

It should also be noted that there can be no physical connection between the first ends 20 of the supporting arms 14, 16, 18. For example, the first ends 20 of the supporting arms 14, 16, 18 can be fixedly secured to a center plate 76 (the center plate 76 will be described in further detail below) or can be releasably be secured to the center plate 76. In the latter instance, as described in more detail below, the supporting arms 14, 16, 18 are pivotable relative to each other and the center plate 76.

The first supporting arm 14, the second supporting arm 16, and the third supporting arm 18 are preferably constructed from a steel square tubing material having a length of approximately three (3') feet and a width of approximately one and one-half (1½") inches. It should be noted, however, that it is within the scope of the present invention to construct the supporting arms 14, 16, 18 from a different material having a different shape with a length greater than or less than approximately three (3') feet and a width greater than or less than approximately one and one-half (1½") inches.

Referring now to FIG. 1, the first supporting arm 14 includes a first leg 24 having a first end 26 and a second end 28. The first end 26 of the first leg 24 is preferably secured to the first end 20 of the first supporting arm 14 at an angle of approximately ninety (90°) degrees. The second supporting arm 16 includes a second leg 30 having a first end 32 and a second end 34. The first end 32 of the second leg 30 is preferably secured to the first end 20 of the second supporting arm 16 at an angle of approximately ninety (90°) degrees. The third supporting arm 18 includes a third leg 36 having a first end 38 and a second end 40. The first end 28 of the third leg 36 is preferably secured to the first end 20 of the third supporting arm 18 at an angle of approximately ninety (90°) degrees. The preferred method of securing the first end 26 of the first leg 24, the first end 32 of the second leg 30, and the first end 38 of the third leg 36 to the first supporting arm 14, the second supporting arm 16, and the third supporting arm 18, respectively, is by welding although securing by other means are within the scope of the present invention.

The first leg 24, the second leg 30, and the third leg 36 are preferably constructed from a steel square tubing material having a length of approximately nine (9") inches and a width of approximately one and one-half (1½") inches. It should be noted, however, that it is within the scope of the present invention to construct the first leg 24, the second leg 30, and the third leg 36 from a different material having a different shape with a length greater than or less than approximately nine (9") inches and a width greater than or less than approximately one and one-half (½") inches.

A disc or plate 42 is preferably secured to the second end 28 of the first leg 24, the second end 34 of the second leg 30, and the second end 40 of the third leg 36. Preferably, each disc 42 is constructed from a steel material having a substantially round configuration with a diameter of approximately three (3") inches although constructing each disc 42 with from other materials having a different configuration greater than or less than three (3") is within the scope of the present invention. The disc 42 provides a footing for each of the legs 24, 30, 36 during installation of the manhole ring 12, which will be described in further detail below.

Figure 3:
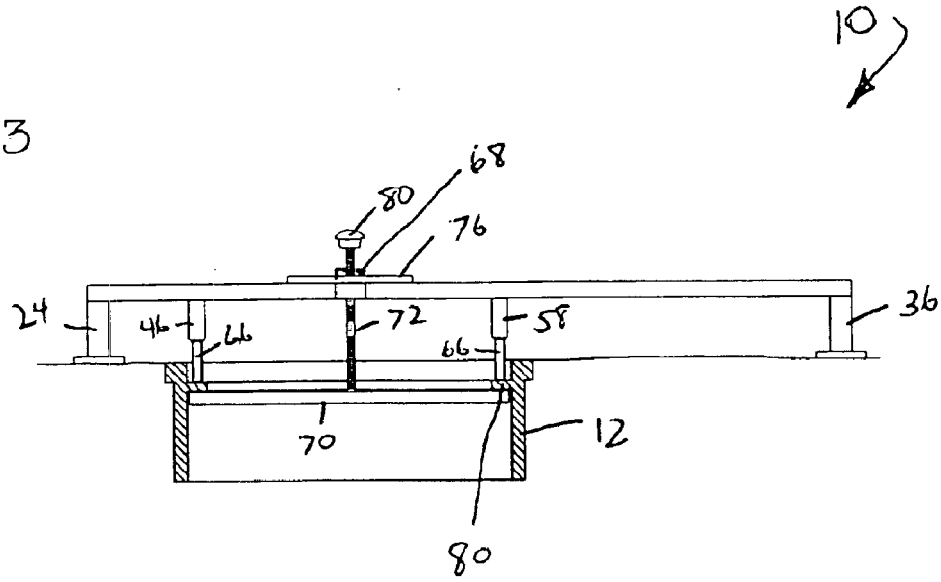
FIG. 3 is an elevational side view illustrating the adjusting device of FIG. 1, constructed in accordance with the present invention, with the manhole ring shown in section releasably secured to the adjusting device.

As illustrated at FIGS. 1, 3, and 4, the adjusting device 10 of the present invention further includes a manhole ring securement assembly 44. The manhole ring securement assembly 44 includes a first extension member 46 having a first end 48 and a second end 50, a second extension member 52 having a first end 54 and a second end 56, and a third extension member 58 having a first end 60 and a second end 62. The first end 48 of the first extension member 46 is secured to the first supporting arm 14 at an angle of approximately ninety (90°) degrees between the first end 20 and the second end 22 of the first supporting arm 14. The first end 54 of the second extension member 52 is secured to the second supporting arm 16 at an angle of approximately ninety (90°) degrees between the first end 20 and the second end 22 of the second supporting arm 16. The first end 60 of the third extension member 58 is secured to the third supporting arm 18 at an angle of approximately ninety (90°) degrees between the first end 20 and the second end 22 of the third supporting arm 18. The preferred method of securing the first end 48 of the first extension member 46, the first end 54 of the second extension member 52, and the first end 60 of the third extension member 58 to the first supporting arm 14, the second supporting arm 16, and the third supporting arm 18, respectively, is by welding although securing by other means are within the scope of the present invention.

Preferably, the first extension member 46, the second extension member 52, and the third extension member 58 are positioned approximately eleven and one-half (11½") inches from the connected first ends 20 of the supporting arms 14, 16, 18. This distance is determined by the standard size of manhole rings. Use of the extension members 46 to position the manhole ring 12 will be described in further detail below.

The first extension member 46, the second extension member 52, and the third extension member 58 are preferably constructed from a steel square tubing material having a length of approximately five (5") inches and a width of approximately one and one-half (1½") inches. It should be noted, however, that it is within the scope of the present invention to construct the extension members 46, 52, 58 from a different material having a different shape with a length greater than or less than approximately five (5") inches and a width greater than or less than approximately one and one-half (1½") inches.

The second end 50 of the first extension member 46, the second end 56 of the second extension member 52, and the second end 62 of the third extension member 58 each preferably have a threaded aperture 64 for receiving an adjusting footing 66. Each adjusting footing 66 preferably has corresponding threads threadably receivable within the threaded aperture 64. Preferably, each adjusting footing 66 is preferably constructed from a three-quarter (¾") inch threaded steel rod although constructing each adjusting footing 66 from another material with other diameters is within the scope of the present invention. The height of the adjusting device 10 relative to the ground can be adjusted by the amount of adjusting footing 66 received within the threaded aperture of the extension members 46, 52, 58. The position of the adjusting footing 66 can be releasably secured by use of a lock nut 68 or other device to releasably maintain the position of each adjusting footing 66 relative to the extension members 46, 52, 58.

The manhole ring securement assembly 44 of the adjusting device 10 of the present application further includes a clamping member 70 secured to a threaded clamping rod 72 extending through the connection between the first ends 26 of the supporting arms 14, 16, 18. The threaded clamping rod 72 extends through a threaded aperture 74 in a center plate 76. Preferably, the threaded clamping rod 72 is preferably constructed from a five-eighths (⅝") inch threaded steel rod although constructing the threaded clamping rod 72 from another material with other diameters is within the scope of the present invention.

Figure 5:
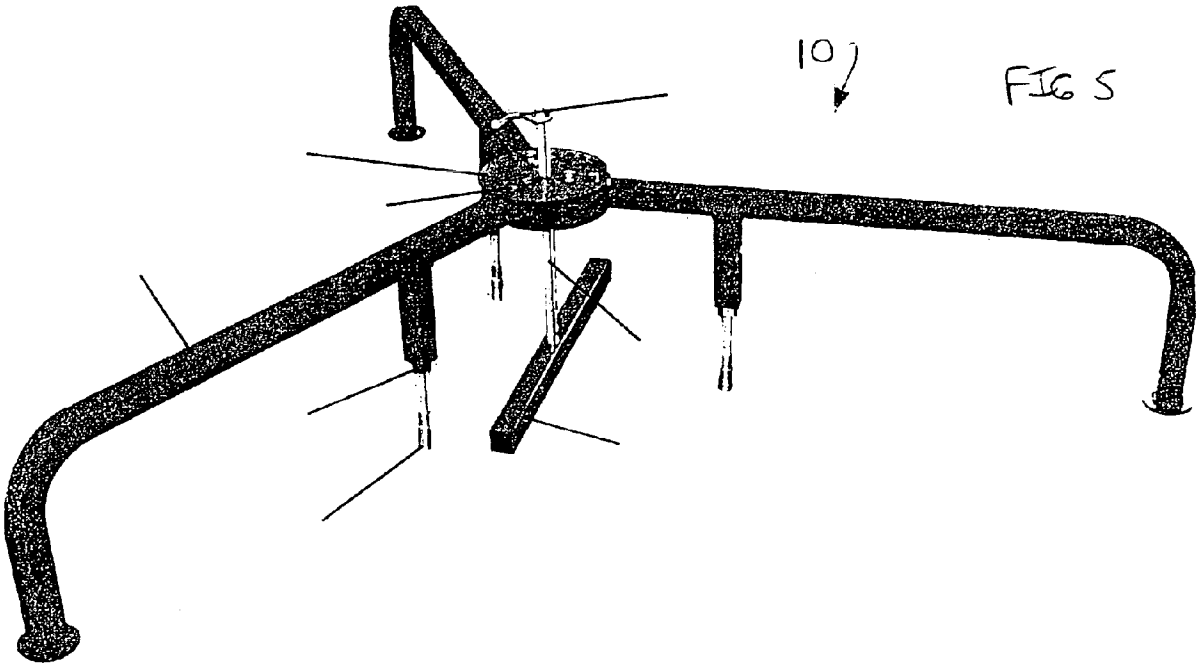
FIG. 5 is a perspective view illustrating another embodiment of the adjusting device for installing a manhole ring onto a manhole, constructed in accordance with the present invention.
Figure 6:
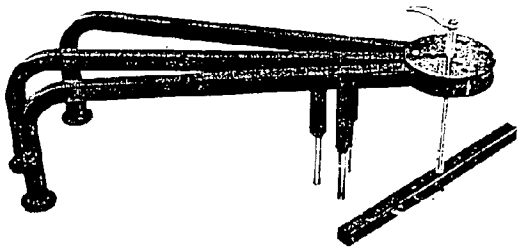
FIG. 6 is a perspective view illustrating the adjusting device of FIG. 5, constructed in accordance with the present invention, with the adjusting device being folded allowing for convenient transportation and storage.

As illustrated in FIGS. 5 and 6, in another embodiment of the adjusting device 10 of the present invention, the center plate 76 comprises a first center plate 82 and a second center plate 84. The support arms 14, 16, 18 are pivotally mounted and releasably secured between the first center plate 82 and the second center plate 84 with first bolts or screws 86 and second bolts or screws 88. The first bolts 86 are removable from the first center plate 82 and the second center plate 84 such that the support arm 16 and the support arm 18 are rotatable about the second bolts toward the support arm 14. Rotation of the support arms 14, 16, 18 allow for easy transportation and storage of the adjusting device 10. The first bolts can then be replaced and secured during transportation and storage.

The clamping member 70 of the manhole ring securement assembly 44 is preferably constructed from a steel square tubing material having a length of approximately twenty-three and one-half (23½") inches and a width of approximately one and one-half (1½") inches. It should be noted, however, that it is within the scope of the present invention to construct the clamping member 70 from a different material having a different shape with a length greater than or less than approximately twenty-three and one-half (23½") inches and a width greater than or less than approximately one and one-half (1½") inches.

As mentioned above, the threaded clamping rod 72 extends through the center plate 76 positioned upon the connection of the first ends 20 of the first supporting arm 14, the second supporting arm 16, and the third supporting arm 18. Preferably, the center plate 76 is constructed from a steel material having a substantially round configuration with a diameter of approximately five (5") inches although constructing each center plate 76 with from other materials having a different configuration greater than or less than five (5") is within the scope of the present invention.

The height of the clamping member 70 relative to the center plate 76 and the supporting arms 14, 16, 18 can be adjusted and releasably secured in place by use of a lock nut 68 or the like threaded onto the threaded clamping rod 72. A soft, resilient cap 78 can be positioned upon the threaded clamping rod 72 to inhibit injury.

The use of adjusting device 10 of the present invention for positioning manhole rings 12 upon manholes will now be described. As will be understood by those persons skilled in the art, other methods and manners of use are within the scope of the present invention.

Referring to FIG. 3, the manhole ring 12 has an annular inner shoulder 80. The clamping member 70 has a length greater than the inside diameter of the annular inner shoulder 80. The clamping member 70 is positioned beneath the annular inner shoulder 80. The extension members 46, 52, 58 are then positioned above the annular inner shoulder 80. The threaded clamping rod 72 of the clamping member 70 and the threaded adjusting footings 66 of the extension members 46, 52, 58 are then adjusted and the lock nuts 68 are tightened thereon to releasably securely clamp the manhole ring 12 between the clamping member 70 and the extension members 46, 52, 58.

The grade of the manhole ring 12 is then pre-adjusted before setting upon the manhole. Pre-adjusting of the grade is accomplished be adjusting the height of the extension members 46, 52, 58 relative to the supporting arms 14, 16, 18 to the proper grade relative to the road surface as determined by government rules and specifications. The manhole ring 12 is then positioned over and upon the manhole.

A SONOTUBE (not shown) or an inflatable tube plug or the like is inserted upon the manhole and within the manhole ring 12. Concrete is then poured on the outside of the manhole ring 12 and allowed to set thereby sealing the inside of the manhole ring 12 and the manhole without the use of concrete rings or grout. The adjusting device 10 of the present invention can then be removed by loosening the lock nuts 68 with the proper angle (angle of the road surface) and grade of the manhole ring being maintained. The adjusting device 10 can then be reused on other manhole ring projects. In fact, once the grade has been set, as described above, additional adjustments are unnecessary unless the adjusting device 10 is used in another jurisdiction with different rules and specifications.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. An adjusting device for installing a manhole ring onto a manhole, the manhole ring having an annular inner shoulder, the adjusting device comprising:

a center plate;

at least one supporting arm having a first end and a second end, the first end securable to the center plate; and a securement assembly associated with the center plate for releasably holding the manhole ring;

wherein the securement assembly includes an extension member on each supporting arm and a clamping member, the clamping member movable relative to the center plate, wherein each extension member is contactable with the annular inner shoulder of the manhole ring and the clamping member is positionable beneath the annular inner shoulder of the manhole ring thereby releasably securing the manhole ring between each extension member and the clamping member.

2. The adjusting device of claim 1 and further comprising a first supporting arm having a first end and a second end, the first end of the first supporting arm securable to the center plate;

a second supporting arm having a first end and a second end, the first end of the second supporting arm securable to the center plate; and a third supporting arm having a first end and a second end, the first end of the third supporting arm securable to the center plate;

wherein the first ends of the first supporting arm, the second supporting arm, and the third supporting arm is fixedly secured to the center plate, the angle between the first supporting arm and the second supporting arm being approximately sixty (60°) degrees, the angle between the second supporting arm and the third supporting arm being approximately sixty (60°) degrees, and the angle between the third supporting arm and the first supporting arm being approximately sixty (60°) degrees.

3. The adjusting device of claim 1 wherein the center plate includes a first center plate and a second center plate, the first supporting arm, the second supporting arm, and the third supporting arm pivotally secured between the first center plate and the second center plate.

4. The adjusting device of claim 3 and further comprising:

at least one removable fastening mechanism for each supporting arm thereby allowing rotation of the supporting arms relative to the first center plate and the second center plate.

5. The adjusting device of claim 1 and further comprising:

a threaded rod between the clamping member and the center plate.

6. The adjusting device of claim 1 wherein each extension member has an adjustable height.

7. The adjusting device of claim 1 and further comprising:

a first leg secured to the second end of the first supporting arm;

a first supporting plate secured to the first leg;

a second leg secured to the second end of the second supporting arm;

a second supporting plate secured to the second leg;

a third leg secured to the second end of the third supporting arm; and a third supporting plate secured to the third leg.

8. The adjusting device of claim 1 wherein the second ends of the first supporting arm, the second supporting arm, and the third supporting arm are bent at an angle of approximately ninety (90°) degrees, and further comprising:

a first supporting plate secured to the second end of the first supporting arm;

a second supporting plate secured to the second end of the second supporting arm; and a third supporting plate secured to the second end of the third supporting arm.

* * * * *